US006896409B2

(12) United States Patent
Plourde et al.

(10) Patent No.: US 6,896,409 B2
(45) Date of Patent: May 24, 2005

(54) ZIPPER HAVING LONGITUDINAL CHANNEL THAT LIMITS RANGE OF SLIDER TRAVEL

(75) Inventors: Eric Paul Plourde, Homewood, IL (US); Steven Ausnit, New York, NY (US)

(73) Assignee: Illinois Tool Works Inc., Glenview, IL (US)

( * ) Notice: Subject to any disclaimer, the term of this patent is extended or adjusted under 35 U.S.C. 154(b) by 70 days.

(21) Appl. No.: 10/267,379

(22) Filed: Oct. 9, 2002

(65) Prior Publication Data

US 2003/0228076 A1 Dec. 11, 2003

Related U.S. Application Data

(63) Continuation-in-part of application No. 10/164,526, filed on Jun. 7, 2002.

(51) Int. Cl.[7] ..... B65D 33/16
(52) U.S. Cl. ..... 383/64; 24/399
(58) Field of Search ..... 383/64; 24/399, 24/400

(56) References Cited

U.S. PATENT DOCUMENTS

| | | | | | |
|---|---|---|---|---|---|
| 2,358,653 | A | * | 9/1944 | Mock | 383/64 |
| 2,581,604 | A | * | 1/1952 | Roehrl | 24/400 |
| 2,696,032 | A | * | 12/1954 | Sander | 24/400 |
| 2,997,765 | A | * | 8/1961 | Markoff-Moghadam | 24/400 |
| 3,074,137 | A | * | 1/1963 | Hawley | 24/400 |
| 3,259,951 | A | | 7/1966 | Zimmerman | |
| 3,266,112 | A | * | 8/1966 | Heckman | 24/400 |
| 5,067,208 | A | | 11/1991 | Herrington et al. | |
| 5,088,971 | A | | 2/1992 | Herrington | |
| 5,131,121 | A | | 7/1992 | Herrington et al. | |
| 5,161,286 | A | | 11/1992 | Herrington et al. | |
| 5,442,837 | A | | 8/1995 | Morgan | |
| 5,448,807 | A | | 9/1995 | Herrington | |
| 5,478,228 | A | | 12/1995 | Dais et al. | |
| 5,636,415 | A | * | 6/1997 | James | 24/399 |
| 5,638,586 | A | | 6/1997 | Malin et al. | |
| 5,809,621 | A | | 9/1998 | McCree et al. | |
| 5,924,173 | A | | 7/1999 | Dobreski et al. | |
| 5,950,285 | A | | 9/1999 | Porchia et al. | |
| 6,047,450 | A | | 4/2000 | Machacek et al. | |
| 6,305,844 | B1 | | 10/2001 | Bois | |
| 6,439,771 | B1 | | 8/2002 | Herrington, Jr. | |
| 6,581,253 | B2 | * | 6/2003 | ErkenBrack | 24/428 |
| 6,662,410 | B2 | * | 12/2003 | Kolovich et al. | 24/399 |
| 2003/0202718 | A1 | | 10/2003 | Tomic | |

FOREIGN PATENT DOCUMENTS

| | | |
|---|---|---|
| GB | 426961 | 4/1935 |
| WO | WO 02/09549 | 2/2002 |
| WO | WO 02/21959 | 3/2002 |

* cited by examiner

*Primary Examiner*—Jes F. Pascua
(74) *Attorney, Agent, or Firm*—Ostrager Chong Flaherty & Broitman P.C.

(57) ABSTRACT

A slider-zipper assembly includes a zipper having two interlockable zipper parts and a slider mounted to said zipper, one or both of the zipper parts having a longitudinal channel with closed ends and a substantially constant profile between the closed ends. The slider causes confronting portions of said the zipper parts to engage during slider travel in a first direction and to disengage during slider travel in a second direction opposite to said first direction. The slider comprises a pair of projections or a single extended projection arranged to project into and travel along the longitudinal channel during slider travel. One closed end of the channel lies in the path of one of the two projections or one end of the extended projection when the slider travels in an opening direction. The other closed end of the channel lies in the path of the other of the two projections or the other end of the extended projection when the slider travels in a closing direction. The closed ends of the channel act as slider end stops, blocking further travel of the slider.

19 Claims, 6 Drawing Sheets

FIG.13
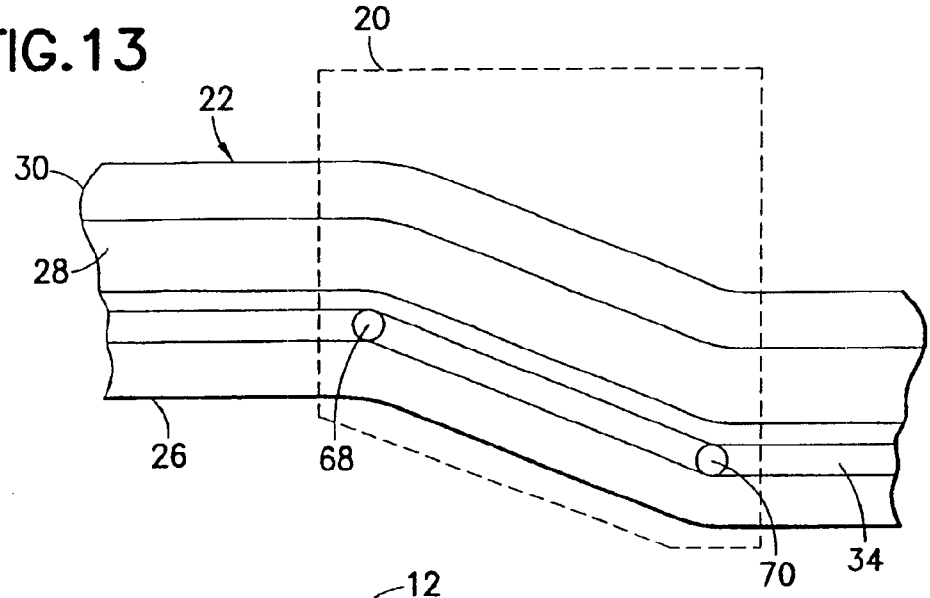
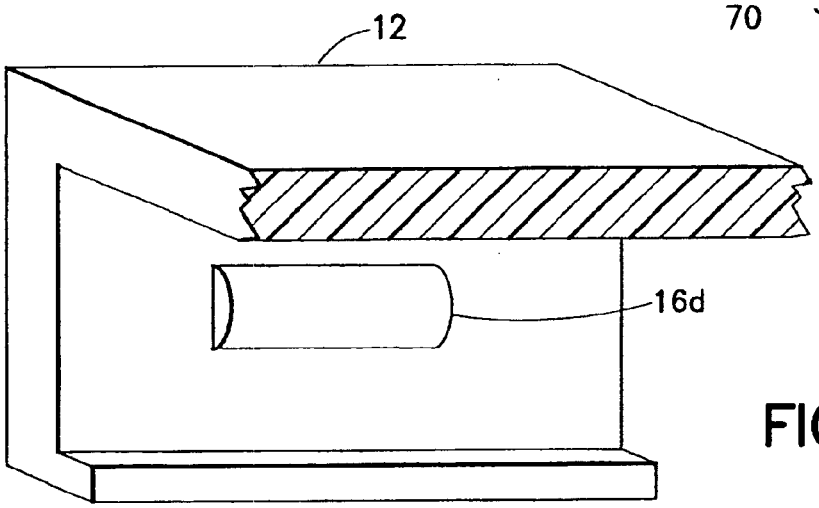
FIG.14
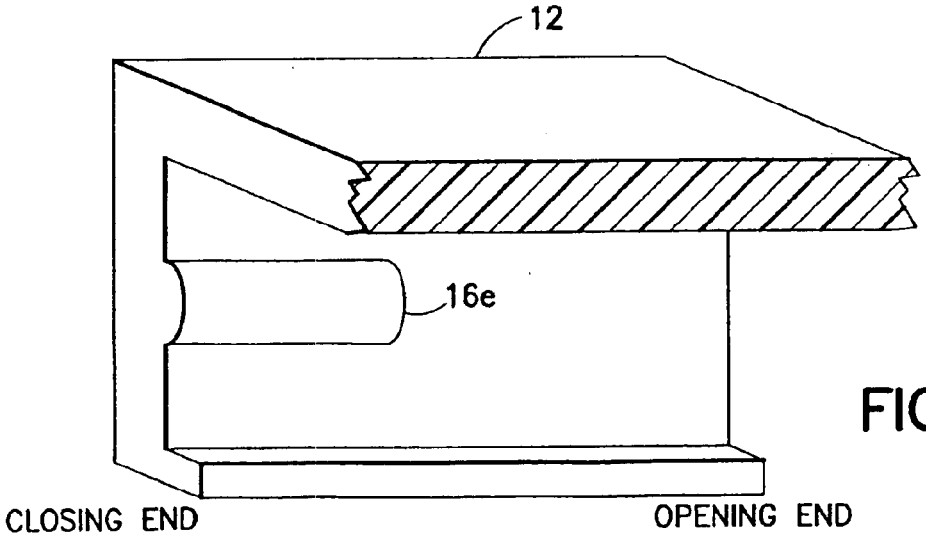
FIG.15

ZIPPER HAVING LONGITUDINAL CHANNEL THAT LIMITS RANGE OF SLIDER TRAVEL

RELATED PATENT APPLICATION

This application is a continuation-in-part application claiming priority from U.S. patent application Ser. No. 10/164,526, which was filed on Jun. 7, 2002.

BACKGROUND OF THE INVENTION

This invention generally relates to slider-operated zippers for use in reclosable packaging, such as bags or pouches. In particular, the invention relates to zippers having slider end stops.

Reclosable bags are finding ever-growing acceptance as primary packaging, particularly as packaging for foodstuffs such as cereal, fresh vegetables, snacks and the like. Such bags provide the consumer with the ability to readily store in a closed, if not sealed, package any unused portion of the packaged product even after the package is initially opened. To gain acceptance as a primary package for foodstuffs, it is virtually mandatory that the package exhibit some form of tamper evidence to protect the consumer and maintain the wholesomeness of the contained product. In addition, in many cases it is necessary that food product be hermetically packaged.

Reclosable fastener assemblies are useful for sealing thermoplastic pouches or bags. Such fastener assemblies typically include a plastic zipper and a plastic slider. Typically, the plastic zippers include a pair of interlockable profiled members that form a closure. As the slider moves across the profiles, the profiles are opened or closed. The profiles in plastic zippers can take on various configurations, e.g. interlocking rib and groove elements having so-called male and female profiles, interlocking alternating hook-shaped closure members, etc. Reclosable bags having slider-operated zippers are generally more desirable to consumers than bags having zippers without sliders because the slider eliminates the need for the consumer to align the interlockable zipper profiles before causing those profiles to engage.

In one type of slider-operated zipper assembly, the slider straddles the zipper and has a separating finger at one end that is inserted between the profiles to force them apart as the slider is moved along the zipper in an opening direction. The other end of the slider is sufficiently narrow to force the profiles into engagement and close the zipper when the slider is moved along the zipper in a closing direction. Other types of slider-operated zipper assemblies avoid the use of a separating finger. For example, U.S. Pat. No. 6,047,450 discloses a zipper comprising a pair of mutually interlockable profiled closure members, portions of which form a fulcrum about which the profiled closure members may be pivoted out of engagement when lower edges of the bases are forced towards each other.

One of the important features of zipper assemblies operated by sliders without separating fingers is the end stop, which prevents the clipped-on slider from falling off when the slider reaches the end of the fastener. A slider end stop is provided on each end of the zipper. End stops have taken on various configurations, such as, for example, riveted end clamps such as those described in U.S. Pat. Nos. 5,067,208 and 5,161,286; transverse end stops made from molten material of the fastener strips, as described in U.S. Pat. No. 5,088,971; tubular end stops, as described in U.S. Pat. No. 5,405,478; a window structure combined with sealed zipper ends, as described in U.S. Pat. No. 5,442,837; plastic end clips fused to the zipper, as described in U.S. Pat. No. 5,448,807; posts with enlarged heads that pass through the ends of the zipper profiles, as described in U.S. Pat. No. 5,924,173; and plastic ribbon, monofilament or clip-shaped segments that conform to the outer shape of and are fused to the zipper profile, as described in U.S. Pat. No. 5,833,791.

A slider end stop must be designed to withstand the forces applied by a consumer during normal use. More specifically, as the consumer pulls the slider to either end of the zipper, the end stop should not bend, fold, collapse or otherwise lose its ability to stop the slider when the slider is pressed against the end stop by the consumer. Preferably a slider end stop has relatively high slider pull-off resistance.

There is a need for improvements in the manufacture and construction of slider end stops for slider-operated zippers. In particular, there is a need for an improved, yet economical method of making a slider end stop having high slider pull-off resistance.

BRIEF DESCRIPTION OF THE INVENTION

The invention is directed in part to a slider-operated zipper wherein a projection on the slider engages and travels along a longitudinal channel in the zipper as the slider travels along the zipper. The channel has obstructions or other means at both ends for limiting the range of slider travel. In particular, the limits are designed to stop the slider from sliding off the end of the zipper. The invention is further directed to reclosable bags or other packages having slider-operated zippers of this type. The invention is also directed to various methods of manufacturing zipper strips, slider-zipper assemblies and reclosable packages.

One aspect of the invention is a slider-zipper assembly comprising a zipper and a slider mounted to the zipper, the zipper comprising first and second interlockable zipper parts. The slider causes confronting portions of the first and second zipper parts to engage during slider travel in a first direction and to disengage during slider travel in a second direction opposite to the first direction. The first zipper part comprises a longitudinal channel having first and second obstructions and a substantially constant profile between the first and second obstructions, while the slider comprises a projection arranged to project into and travel along the longitudinal channel during slider travel, the first obstruction obstructing further travel of the slider in the first direction when the projection impinges thereon.

Another aspect of the invention is a slider-zipper assembly comprising a zipper and a slider mounted to the zipper, wherein the first zipper part comprises a longitudinal channel having first and second closed ends and a substantially constant profile between the first and second closed ends, while the slider comprises a projection arranged to project into and travel along the longitudinal channel during slider travel, the first closed end being in the path of the projection when the slider travels in the first direction.

A further aspect of the invention is a slider-zipper assembly comprising a zipper and a slider mounted to the zipper, wherein the first zipper part comprises a longitudinal channel having first and second end stops disposed in the channel, while the slider comprises means that project into the longitudinal channel during slider travel, the first slider end stop posing an obstacle to further travel of the slider in the first direction when the projecting means impinge on the first end stop, and the second slider end stop posing an obstacle to further travel of the slider in the second direction when the projecting means impinge on the second end stop.

Other aspects of the invention are reclosable package comprising a receptacle having a mouth, and a slider-zipper assembly of any of the types described in the preceding three paragraphs. The zipper can be either joined to or integrally formed with the receptacle at the mouth thereof.

Another aspect of the invention is a method of manufacturing a zipper strip with slider end stops, the method comprising the following steps: extruding a zipper strip having a longitudinal channel; and partially or fully obstructing the channel at spaced intervals therealong.

Yet another aspect of the invention is a method of manufacturing a zipper strip with slider end stops, the method comprising the following steps: extruding a zipper strip; and forming a multiplicity of aligned longitudinal channels in the zipper strip at spaced intervals therealong, the channels being formed by removing material from the zipper strip.

A further aspect of the invention is a method of manufacturing reclosable packaging material, comprising the following steps: extruding a web of bag making film having first and second mutually interlockable profiled closure members respectively integrally formed with opposing sides of the web, the first closure member comprising a longitudinal channel; and partially or fully obstructing the channel at spaced intervals therealong.

Another aspect of the invention is a method of manufacturing reclosable packaging material, comprising the following steps: extruding a web of bag making film having first and second mutually interlockable profiled closure members integrally formed with the web on opposing sides thereof; and forming a multiplicity of aligned longitudinal channels in the first closure member at spaced intervals therealong, the channels being formed by removing material from the first closure member.

Other aspects of the invention are disclosed and claimed below.

BRIEF DESCRIPTION OF THE DRAWINGS

In FIG. 2 the zipper is closed, while in FIG. 3 the zipper is open.

FIG. 11 shows a section through a portion of the slider adjacent the closing end of the slider, with the zipper closed. FIG. 12 shows a section through a portion of the slider adjacent the opening end of the slider, with the zipper open. [To facilitate the reader's understanding, structure that would ordinarily be visible behind the plane of sectioning has not been shown.]

FIG. 13 is a drawing showing a side elevational view of the zipper part that is vertically displaced by the slider in accordance with another embodiment of the invention. The slider is indicated by dashed lines, except for the camming pins, which are shown in solid lines.

FIGS. 14 and 15 are drawings showing fragmentary isometric views of respective sliders in accordance with additional alternative embodiments of the invention.

Reference will now be made to the drawings in which similar elements in different drawings bear the same reference numerals.

DETAILED DESCRIPTION OF THE INVENTION

The present invention has application in reclosable packages wherein the zipper halves disengage by relative displacement in a horizontal plane as well as in reclosable packages wherein the zipper halves disengage by relative displacement in a vertical plane. Embodiments of the first type will be described with reference to FIGS. 1–10, 14 and 15. Embodiments of the second type will be described with reference to FIGS. 11–13.

Figure 1:
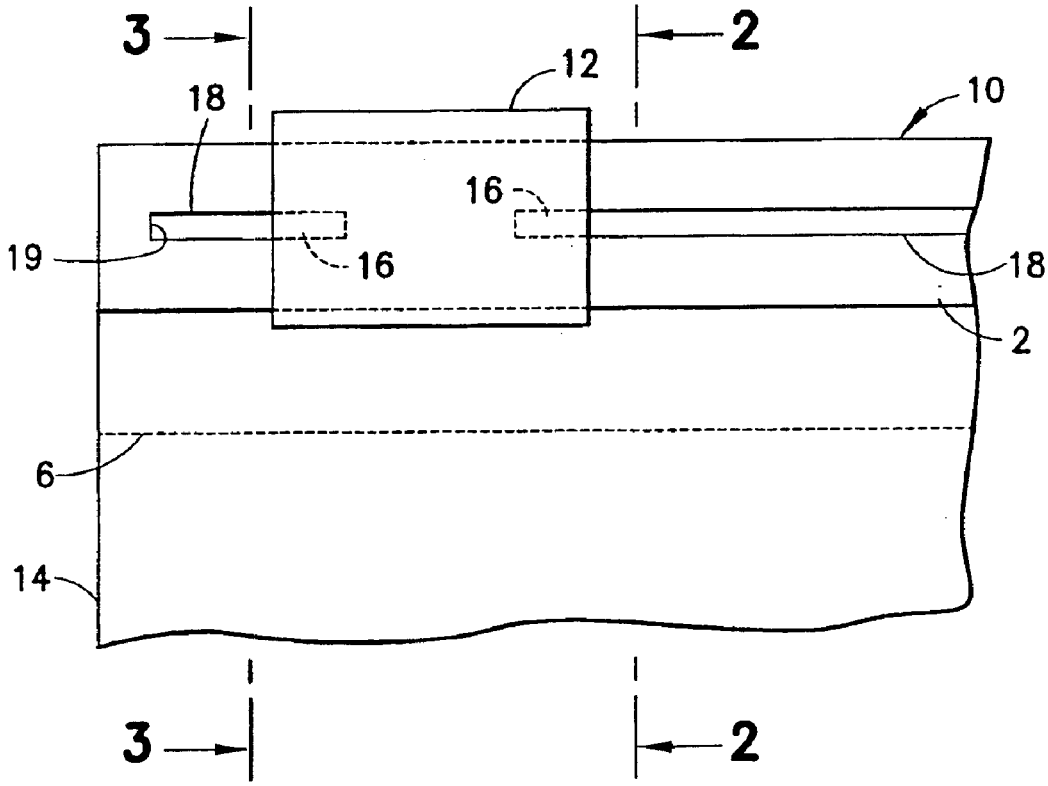
FIG. 1 is a drawing showing a fragmentary front elevational view of a reclosable package incorporating a slider-zipper assembly in accordance with one embodiment of the invention.

In one embodiment shown in FIGS. 1–4, a reclosable bag comprises a slider-zipper assembly of the fulcrum type. The assembly comprises a plastic zipper 10 and a plastic slider 12 mounted to and straddling the zipper 10. The zipper 10 comprises first and second interlockable profiled closure members 2 and 4 joined along respective sections proximal to respective ends of the zipper. In the illustrated case, the closure members 2 and 4 are joined along end sections of the zipper, only one of which is shown in FIG. 1.

Figure 2:
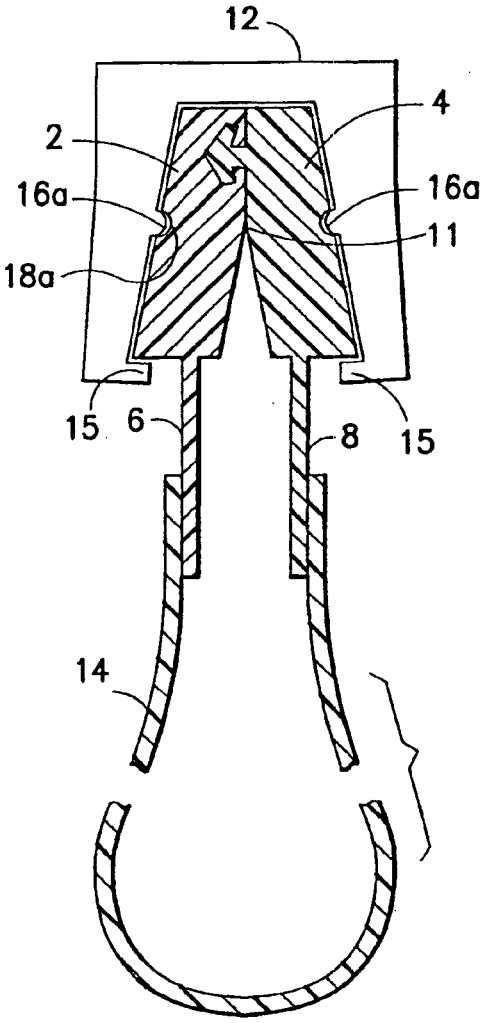
FIGS. 2 and 3 are drawings showing sectional views of the portion of reclosable package depicted in FIG. 1, the sections being respectively taken along lines 2—2 and 3—3 indicated in FIG. 1.
Figure 3:
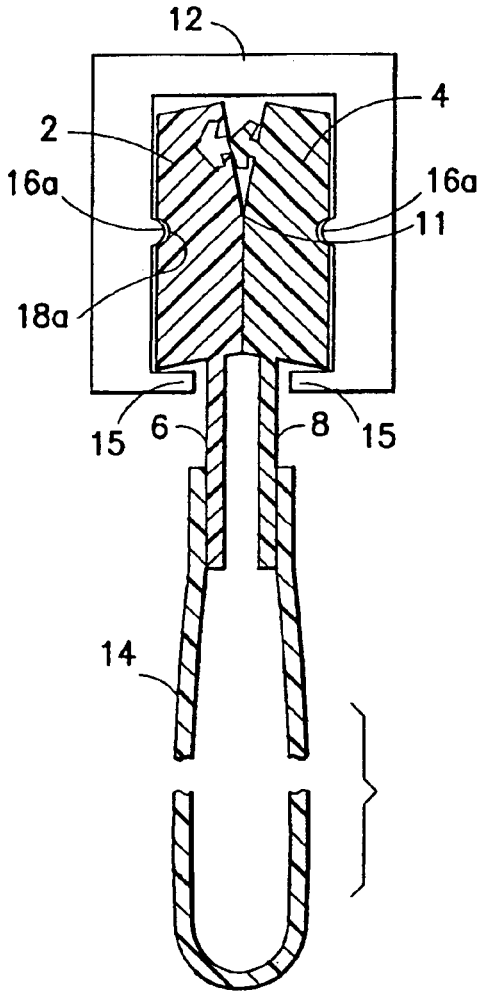

As best seen in FIGS. 2 and 3, a web of bag making film 14 may be folded at the bottom to form a front wall and a rear wall. Although not shown in FIGS. 2 and 3, the front and rear walls are also joined at the sides of the package, at least from the bottom to the slider end stops on the zipper, by respective side seals. Alternatively, the walls could be separate panels that are sealed together at their bottom edges as well as at their side edges. The bag making film is a plastic material suitable for the product to be contained within the package. For example, the film may be a laminate or coextrusion comprising a gas barrier layer and/or a low-melting-point sealant layer.

The zipper 10 comprises a closure member 2 having a female profile and a closure member 4 having a male profile that interlocks with the female profile in the zipper section being closed as the slider travels in the closing direction. The zipper 10 further comprises a zipper flange 6 having one end connected or joined to closure member 2 and a zipper flange 8 having one end connected or joined to closure member 4.

The zipper flange 6 is typically secured to one bag wall by a permanent seal proximal to the top of the bag, while zipper flange 8 is secured to the other bag wall by a permanent seal. It should be appreciated that each permanent seal is a band of joined, e.g., fused, material that extends from one side seal of the bag to the other side seal, thereby securing the zipper to the bag along the width of the bag. These permanent seals are generally parallel to each other and may be formed by any conventional method, such as conduction heat sealing.

FIGS. 2 and 3 illustrate a dual flange zipper. Alternatively, the zipper flanges could be connected at their distal ends to form a cusp, with a line of reduced tear resistance running along the cusp. In accordance with a further alternative, a split-flange zipper could be manufactured by extruding the zipper profiles onto a continuous membrane, which membrane is later cut on one side to form the split flanges, one being longer than the other. The short flange would be sealed to one bag wall, while the long flange would be sealed to both walls of the receptacle. The long flange is folded to form a cusp having a line of reduced tear resistance therein. In a further alternative, the zipper profiles and the bag making film could be extruded as one piece.

In the embodiment depicted in FIGS. 2 and 3, the zipper 10 and slider 12 form a slider-zipper assembly of the fulcrum type. The outer surfaces of the closure members are not parallel, but diverge downwardly to form a shape that resembles the letter "A". Because of this "A" configuration, the zipper is difficult to open from the contents (i.e., product) side of the receptacle since the opening force tends to push the lower extremities of the profiled closure members apart, thereby enhancing the interlock between the male member and the female member. The closure members 2 and 4 have opposing portions that form a fulcrum 11. Although FIGS. 2 and 3 show the fulcrum 11 as being at the contact point of opposing convex portions, the fulcrum may alternatively be formed by a concave portion on one closure member contacting a convex portion on the other closure member. The details of such a structure can be found in U.S. Pat. No. 6,047,450.

When the distal edges of the closure members 2 and 4 are forced towards each other by the side walls of the slider 12, the resulting leverage causes the closure members to pivot oppositely about the fulcrum 11 and disengage from each other, as shown in FIG. 3.

The slider 12 can be top-loaded onto the zipper 10 without having to disengage the profiled closure members at the loading point since the slider does not make use of a separating finger. The slider is slidable along the zipper in either a closing direction or an opening direction opposite to the closing direction. The profiled closure members 2 and 4 are fully engaged, i.e., interlocked, with each other as the slider travels in the closing direction. The profiled closure members 2 and 4 are disengaged from each other as the slider travels in the opening direction. The slider 12 is preferably made of a resilient plastic material, such as delrin, polypropylene, PBT, etc.

FIG. 2 depicts a closing end of the slider, while FIG. 3 depicts an opening end of the slider. The closing end is shaped to force the profiled closure members 2 and 4 into engagement when the slider 12 travels in the closing direction. The closing end is so-called because it is the end where the zipper profiled closure members 2, 4 are forced into engagement when the slider 12 is moved in the closing direction. During slider travel in the closing direction, the closing end is the trailing end of the slider. Similarly, during slider travel in the opening direction, the opening end of the slider is trailing.

The slider 12 straddles the zipper 10 and has a top wall from which a pair of arms or sidewalls depend. However, a top wall running the full length of the slider is not necessary. As an alternative construction, for example, the sidewalls could be connected to respective ends of a pair of top beams that are parallel to each other. One top beam and adjoining portions of the sidewalls would be configured to act as an opening window, while the other top beam and adjoining portions of the sidewalls would be configured to act as a closing window. As seen in FIGS. 2 and 3, the slider arms or sidewalls are respectively provided with retaining shoulders 15 having upper surfaces that mate with lower surfaces of the profiled closure members 2 and 4. These surfaces may be tapered to maximize their pull-off resistance. The mating of these surfaces, in combination with the "A" configuration of the profiled closure members 2, 4, prevents the slider 12 from being inadvertently pulled off the zipper 10 during use, since an upward pulling motion will tend to pull the profile bases apart at their distal ends, thereby locking the slider 12 onto the zipper 10.

In accordance with the embodiment of the invention shown in FIG. 1, a longitudinal channel 18, which opens laterally outward, is formed in the profiled closure member 2. The channel 18 is closed at both ends, one closed end 19 being indicated in FIG. 1. The channel has a constant profile along its length, which is less than the length of the zipper due to the end stops. The channel 18 runs parallel to the interlocked zipper profiles (not shown in FIG. 1).

In addition, the slider 12 is provided with a pair of projections 16 formed on the interior of one of the sidewalls of the slider at the same distance from the top of the slider, one projection 16 being disposed at or near the opening end of the slider and the other projection 16 being disposed at or near the closing end of the slider. Both projections are designed to project into the channel 18 and be guided by the walls of the channel 18 during slider movement along the zipper. The slider and zipper are designed so that during slider movement in one direction, the leading projection 16 inside the slider 12 will eventually impinge upon an obstructing closed end 19 of the channel 18. In the event that the slider is moving in the zipper opening direction, the slider will be stopped when the endface of the projection 16 at the closing end of the slider meets a confronting closed end 19 of the channel 18. Conversely, when the slider is moved in the zipper closing direction, the slider will be stopped when the endface of the projection 16 at the opening end of the slider meets a confronting closed end 19 of the channel 18.

FIG. 1 shows only one longitudinal channel on one side of the zipper with closed ends that function as slider end stops. One channel with closed ends is sufficient to stop the slider from being pulled off the ends of the zipper. However, it should be appreciated that the other side of the zipper can be provided with an identical channel, while the other sidewall of the slider has a pair of interior projections identical to projections 16. In this variation, the closed ends of the two parallel channels on opposite sides of the zipper are located at substantially the same longitudinal positions, so that they act concurrently as balanced end stops when the slider reaches a respective park position. The closed ends of the two channels respectively formed in the zipper closure members at one end of the zipper form a slider end stop that stops the slider at a first park position. It should be appreciated that the other end of the zipper will be similarly constructed to stop the slider at a second park position. Thus the slider is movable only along the path between the first and second park positions located at opposite ends of the zipper. In one slider park position, the zipper is fully open; in the other slider park position, the zipper is fully closed.

As seen in FIG. 1, the closed end 19 of the channel 18 obstructs further leftward travel of the slider 12, thereby stopping the slider from being pulled off the end of the zipper, provided that the pull-off resistance is not overcome. The same action occurs when the slider is moved to the opposite end of the zipper (not shown in FIG. 1). In the case where the stopping surface 19 is generally perpendicular to the longitudinal axis of the zipper, the planar end faces of the impinging projection 16 is also preferably generally perpendicular to the longitudinal axis of the zipper. Therefore, when the end face of the projection impinges on the stopping surface, the contacting surfaces are generally parallel to each other. Similarly, if the stopping surface 19 is disposed at an acute angle relative to the transverse plane, then the end face of the impinging projection 16 should be disposed at the same angle.

Moreover, as will be made apparent below during the discussion of different methods of manufacture, the channel 18 need not have completely closed ends. It is only necessary that sufficient material be placed in the path of the impinging slider projection that the projection is obstructed in its forward progress and cannot travel further along the channel. In accordance with one variation, the longitudinal channel 18 formed in the zipper could extend the entire length of the zipper and the slider end stops are formed by constricting or narrowing the channel at appropriate locations near the respective ends of the zipper.

Figure 4:
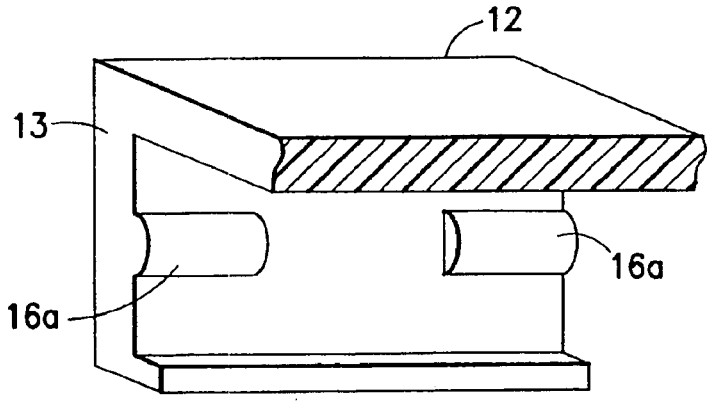
FIG. 4 is a drawing showing a fragmentary isometric view of the slider depicted in FIGS. 1–3.

FIGS. 2–4 illustrate a particular embodiment wherein the projections 16 and the channel 18 having semicircular profiles, with the radius of the channel profile naturally being slightly greater than the radius of the projections to allow the latter to fit inside the former. As seen in FIG. 4, the slider 12 has a pair of spaced-apart projections 16*a* having congruent semicircular profiles and collinear longitudinal axes. FIG. 4 depicts a slider wherein the external endface of each projection, which forms the contacting surface with the slider end stop, is flush with the respective slider endface 13. However, the projection endfaces that contact the end stops need not be flush with the corresponding slider endfaces, but could also lead or lag the slider endface. Nor do the contacting projection endfaces need to be transverse to the longitudinal axis of the zipper. Both the end stop surface and the contacting projection endface could be obliquely disposed, but in parallel with each other.

As seen in FIGS. 2 and 3, the projections 16*a* at both ends of the slider 12 are located at the same level or elevation as the fulcrum 11 of the zipper. At the level of the fulcrum, the width of the zipper remains substantially the same whether the zipper is opened or closed. The elevation of the slider projections may be varied for different types of zippers, such as zippers that do not have a fulcrum point.

Figure 5:
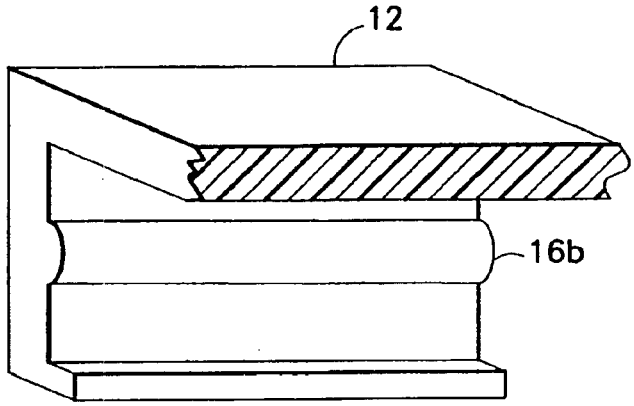
FIGS. 5 and 6 are drawings showing fragmentary isometric views of respective sliders in accordance with alternative embodiments of the invention.

As seen in FIG. 5, the respective projections at opposing ends of the slider can be extended to meet in the middle, forming a single extended projection or rib 16*b*, which increases the coupling the slider to the zipper groove without undermining the slider end stop function. One drawback of a single extended projection or rib, however, is that the friction between the slider and zipper groove during slider is necessarily increased. Alternatively, the single projection on one sidewall need not extend to the ends of the slider. As seen in FIG. 14, a single projection 16*d* may be located in a mid-portion of one or both sidewalls.

In accordance with yet another embodiment depicted in FIG. 15, on one or both sidewalls a single projection 16*e* is located at the closing end of the slider while there is no projection at the opening end of the slider. This embodiment would allow the opening end to overhang the fused portion of the zipper so that the entire openable portion of the profile will be closed when the slider is parked in the closed position.

It should be appreciated that the channel 18 and associated slider projections 16 may have profiles other than semicircles. For example, the profiles can be square, rectangular, trapezoidal, elliptical, parabolic, hyperbolic, etc. To reduce friction between the channel 18 and the slider projections 16, the former may have a profile that does not match the profiles of the projections. For example, the end stop channel could have a rectangular profile, while the slider projections each have a generally rectangular profiles with two rounded corners at the distal end of the profile. Having curved surfaces on the sliding projections in contact with planar surfaces inside the end stop channel reduces the area of contact between the channel and the projections, thereby reducing the friction and making it easier for the bag user to operate the slider.

Figure 6:
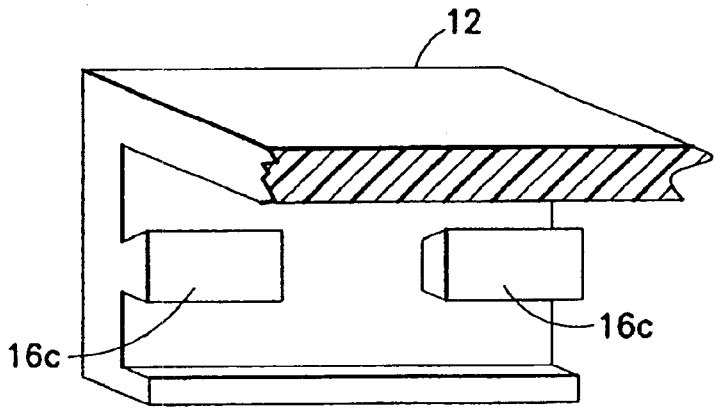
Figure 7:
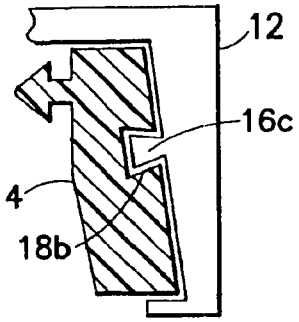
FIG. 7 is a drawing showing a fragmentary sectional view of the slider of FIG. 6 coupled to a zipper part.

In order to positively lock the slider to the zipper, the slider projection may be formed with a maximum width at a distance from its base, and the end stop channel has an opening of width less than the maximum width of the projection and greater than the width at the base of the projection. In this situation, the end stop channel grips the slider projections and resists the slider projections being pulled out of the channel. One example of such an arrangement is depicted in FIGS. 6 and 7. As seen in FIG. 6, the slider 12 has a pair of spaced-apart projections 16*c* having congruent trapezoidal profiles and collinear longitudinal axes, with the short base of the trapezoid forming the base of each projection. As seen in FIG. 7, the channel 18*b* in the closure member 4 of the zipper has a profile that form fits to the shape of the projections 16*c*. The projections 16*c* cannot be disengaged from the channel 18*b* unless sufficient force is applied to pry open the mouth of the channel, which is narrower than the maximum width at the distal end of the projections 16*c*. This feature provides resistance to the slider being pulled or tilted upward and becoming disengaged from the zipper. While the pull-off resistance provided by this feature is in addition to the pull-off resistance provided by latching of the retaining shoulders 15 of the slider underneath the closure member, it will be seen later that this feature can be advantageously employed in cases where the slider has no retaining shoulders, such as the embodiment depicted in FIGS. 11 and 12, to be described in detail below.

Although the embodiments disclosed herein have one or two longitudinal channels formed in the sides of the zipper, it is also possible to form a functionally equivalent channel in the top of one of the zipper closure members. In such an arrangement, projections would depend from the internal surface of the top wall of the slider or from respective internal surfaces of a pair of cross beams of the slider.

The embodiment depicted in FIG. 1 can be manufactured by extruding a continuous zipper strip comprising a profiled closure member and a zipper flange wherein the side of the closure member opposite the interlockable profile does not have longitudinal grooves. Instead the longitudinal grooves are formed subsequent to cooling of the extruded zipper strip, e.g., by cutting. A series of grooves are formed at regular spaced intervals. The ungrooved intervals form closed ends of successive grooves and are subsequently bisected to form the end of a package-length zipper segment. The other extruded zipper strip can be processed in the same way or left without grooves, if the zipper will have only one longitudinal channel for stopping the slider at its ends. The two zipper strips are then interlocked to form a zipper tape that can be wound on a reel and fed later to a slider insertion device. Typically, before the sliders are inserted, the zipper strips are fused together in spaced-apart zones. The zipper tape with sliders inserted thereon is then fed to a zipper application station, where a zipper segment with mounted slider is severed, in the middle of a fused zone, from the remainder of the zipper tape and attached to a web of bag making film. The film with slider-zipper assemblies attached thereto is intermittently advanced toward a conventional form-fill-seal machine.

Figure 8:
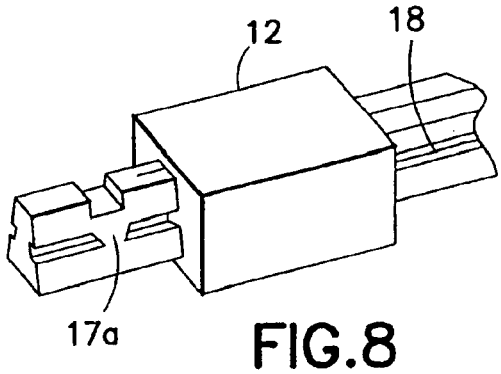
FIGS. 8–10 are drawings showing isometric views of three additional embodiments of the invention having different types of slider end stops.
Figure 9:
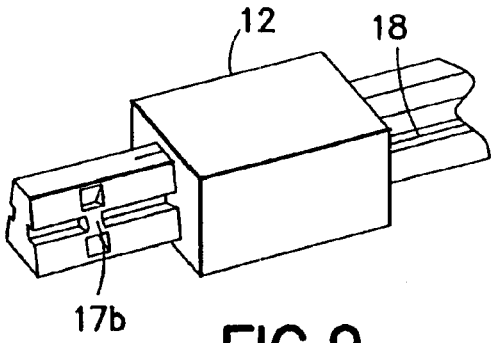
Figure 10:
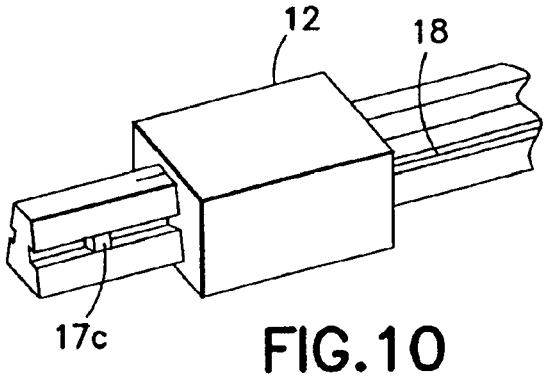

Other methods of manufacture are shown in FIGS. 8–10. In each of these embodiments, the continuous zipper strip is extruded with a continuous groove. Slider end stops are then formed in the continuous groove by displacing some of the plastic zipper strip material into the groove at spaced intervals (two examples are shown in FIGS. 8 and 9) or by inserting plastic material into the groove at spaced intervals (as shown in FIG. 10). In the cases shown in FIGS. 8 and 9, the displacement of plastic zipper material into the continuous groove can be combined with the step of fusing the interlocked zipper parts together. This can be accomplished by applying heat and pressure or by applying ultrasonic wave energy and deforming the softened material.

In the embodiment shown in FIG. 8, the plastic material of the zipper is displaced downward to form a dam 17*a* in the channel, leaving a recess in the top of the zipper. Although FIG. 8 depicts this step being performed while the zipper strips are interlocked and joined, the same technique could be applied to a grooved zipper strip before it is interlocked with a mating zipper strip.

In the embodiment shown in FIG. 9, plastic material in the side of the grooved zipper strip has been displaced upward and downward to form a dam 17*b* in the channel, leaving respective recesses above and below the dam. Again, although FIG. 9 depicts this step being performed while the zipper strips are interlocked and joined, the same technique could be applied to a grooved zipper strip before it is interlocked with a mating zipper strip.

FIG. 10 depicts the case where a piece 17*c* of material is inserted into the longitudinal groove 18 to form a slider end stop. The added material can be plastic, but need not be. This step is repeated at spaced intervals along the zipper strip. In one variation, the inside of a section of channel can be heated until the walls and floor of the channel section soften. Then the piece of added material can be inserted into the channel and pressed against the softened channel section. The piece of added material is held in place until the softened channel has cooled sufficiently to cause the channel section and the piece of added material to be fused. Alternatively, the contacting surfaces of a piece of added plastic material could be softened and then inserted into the channel so that the softened regions contact the floor and walls of the channel 18. For this purpose, the piece may be made of the same plastic material as that of the zipper or some other compatible plastic material. Alternatively, a piece of added material could be formed to fit snugly inside the channel and then glued in place. In accordance with yet another alternative, added material in a molten state could be spot welded in the channel at the desired location, such molten material cooling to form a slider end stop. Another alternative is to form a throughhole that communicates with the channel 18 and then insert a post or rivet inside the throughhole, with a portion of the post or the head of the rivet projecting into the channel to function as a slider end stop.

Figure 12:
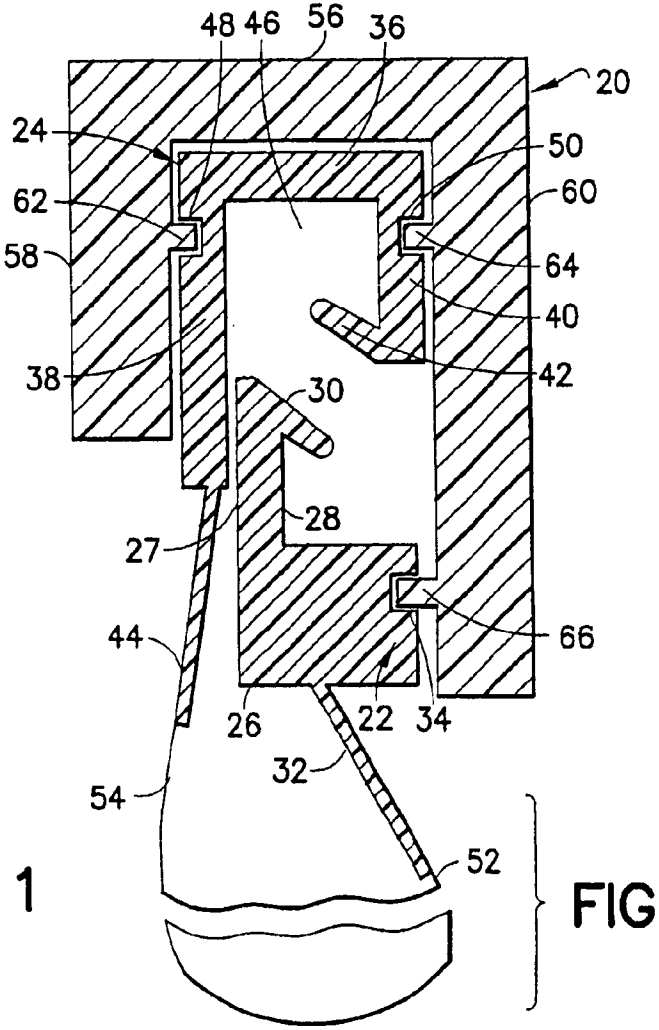
FIGS. 11 and 12 are drawings showing sectional views of a slider-zipper assembly in accordance with another embodiment of the invention. The sections are taken in planes perpendicular to the longitudinal axis of the zipper.
Figure 11:
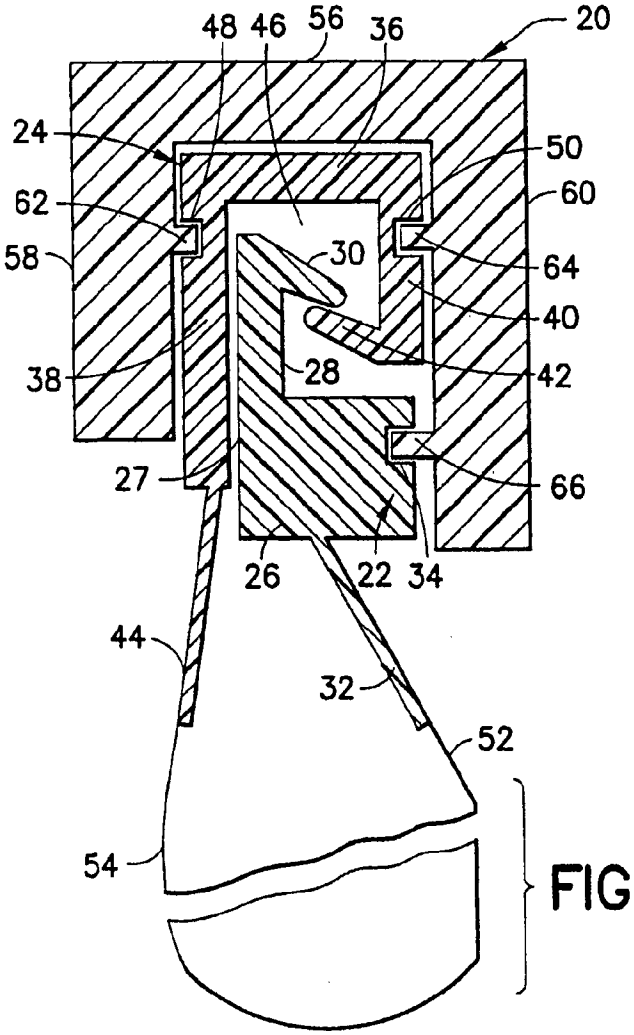

A zipper channel or groove with closed ends acting as slider end stops can also be incorporated in slider-operated zippers wherein the zipper halves engage and disengage by displacing in a vertical plane. FIGS. 11 and 12 show cross-sectional views of a slider-zipper assembly in accordance with an embodiment of this type. The closing end of a slider 20 is shown in FIG. 11; the opening end of the slider 20 is shown in FIG. 12. The zipper is shown in FIG. 11 in a closed state with zipper halves interlocked; the zipper is shown in FIG. 12 in an opened state with the zipper halves disengaged. The zipper comprises first and second fastener strips or zipper parts 22 and 24. Each zipper part is preferably made by extruding thermoplastic material to form a strip with a constant profile.

The first zipper part 22 comprises a base 26, a stem 28 connected to the base 26, a detent 30 connected to the stem 28, and an extension flange 32 connected to the base 26. The stem 28 and detent 30 form a hook. The hook and the extension flange 32 extend on opposite sides of the base 26. It should be appreciated that FIG. 11 shows only the profile of zipper part 22 and that the part extends into and out of the page. The base 26 has a longitudinal channel or groove 34 formed on a side thereof (which groove also extends into and out of the page), facing outward on the side surface. An upper section of a rear bag wall panel 52 is joined to the extension flange 32 by any conventional means.

The second zipper part 24 comprises a top wall 36, a first side wall 38 connected to one end of the top wall 36, a second side wall 40 connected to the other end of the top wall 36, a detent 42 connected to a distal portion of the second side wall 40, and an extension flange 44 connected to a distal portion of the first side wall 38. The side walls 38 and 40 are mutually opposed and may be generally parallel to each other and generally perpendicular to the top wall 36. However, mutual parallelism of the side walls 38 and 40 is not necessary. For example, the second zipper part could be A-shaped, with the first zipper part shaped accordingly.

The first side wall 38 of the second zipper part 24 has a longitudinal channel or groove 48 that faces outward on its exterior surface (which groove extends into and out of the page). The second side wall 40 has a longitudinal channel or groove 50 that faces outward on its exterior surface (which groove extends into and out of the page). An upper section of a front bag wall panel 54 is joined to the extension flange 44 by any conventional means. The front and rear bag wall panels 52 and 54 may be connected at the bag bottom by a fold, as shown in FIG. 11, or by a lap seal, a bottom panel, or a gusset (not shown), or by any other conventional bag structure.

The walls 36, 38 and 40 of zipper part 24 define a longitudinal channel 46 that receives the head of the zipper part 22, i.e., the detent 30, when the depicted sections of the zipper parts are interlocked, i.e., when the depicted zipper section is closed, as shown in FIG. 11. As seen in FIG. 12, the zipper part 22 is displaced vertically downward relative to the zipper part 24 to an extent that causes the zipper parts to disengage. When the zipper parts along a particular zipper section are disengaged, i.e., when the detent 30 has been removed from the channel 46, this section of the zipper is open.

Opening and closing of the zipper is performed by manipulation of a slider 20. The sliders of the embodiments disclosed herein are designed to cause the zipper part 22 to displace vertically relative to the zipper part 24. As used herein, the term "vertical" refers to a direction that is generally perpendicular to a top wall 56 of the slider (remembering again that the top wall extends into and out of the plane of the sectional view shown in FIGS. 11 and 12. The slider 20 further comprises a first side wall 58 connected to one end of the top wall 56 and a second side wall 60 connected to the other end of the top wall 56. The side walls 58 and 60 are mutually opposed and may be generally parallel to each other and generally perpendicular to the top wall 56. However, mutual parallelism of the slider side walls is not necessary. For example, if the zipper has an A-shape, then the slider profile would also be A-shaped.

The first side wall 58 of the slider 20 has a longitudinal projection 62 that is received in groove 48 in the zipper part 24, while the second side wall 60 has a longitudinal projection 64 that is received in groove 50 in the zipper part 24.

The projections 62 and 64 are mutually parallel and slide along grooves 48 and 50 during sliding movement of the slider 20 in either the opening or the closing direction. Thus, the slider 20 rides on and is supported by, i.e., is slidably mounted to, the second or outer zipper part 24. The zipper part 24 does not displace vertically relative to the slider 20 during slider movement. One or both of the grooves 48 and 50 in zipper part 24 has closed ends that act as slider end stops, stopping the slider when a confronting end of the associated longitudinal projection 62 or 64 impinges against a closed end.

In contrast, the first or inner zipper part 22 displaces vertically relative to the slider 20 during slider movement. During slider movement in the opening direction, the zipper part 22 displaces from the position shown in FIG. 11 to the position shown in FIG. 12. Conversely, during slider movement in the closing direction, the zipper part 22 displaces from the position shown in FIG. 12 to the position shown in FIG. 11. These vertical displacements are caused by camming means 66, incorporated in the slider 20, which engage the base 26 of the first zipper part 22 and cam the latter vertically upward or downward, depending upon the direction of slider movement.

More specifically, the camming means shown in FIGS. 11 and 12 comprise a projection 66 that projects from an inner surface of the second side wall 60. The second side wall extends from an opening end to a closing end of the slider. The projection 66 comprises a first end portion located closer to the closing end than to the opening end and a second end portion located closer to the opening end than to the closing end. The first end portion of the projection 66 is depicted in the sectional view shown in FIG. 11, the section being taken near the closing end of the slider. The second end portion of the projection 66 is depicted in the sectional view shown in FIG. 12, the section being taken near the opening end of the slider. As can be seen, the projection end near the slider closing end is located closer to the top wall 56 of the slider than is the projection end near the slider opening end. Alternatively, the projection 66 may take the form of two or more spaced rail segments (not shown).

In accordance with another embodiment of the invention, instead of an inclined rail, a pair of pins can be used to cam the first zipper part up or down relative to the slider and the second zipper part. This embodiment is partly depicted in FIG. 13, which shows a section of the first zipper part 22 in solid lines and the slider 20 in dashed lines. The second zipper part is not shown. FIG. 13 also shows the respective locations of a pair of camming pins 68 and 70, which engage the groove 34 formed in the base 26 of the first zipper part 22. The camming pins 68 and 70 would correspond in location to the end portions of the linear projection, i.e., rail, previously described. As seen in FIG. 13, when the slider 20 is moved to the right, the pin 68 will cam the related portion of zipper part 22 upward, pushing it into engagement with the second zipper part, i.e., closing that section of the zipper. Conversely, when the slider is moved to the left, the pin 70 will cam the related portion of the zipper part 22 downward, pulling it out of engagement with the second zipper part, i.e., opening that section of the zipper.

A person skilled in the art will recognize that one channel with end stops at both ends can be provided on one or both zipper parts. Alternatively, more than one channel with end stops can be provided on one side or both sides of the zipper. Naturally, the slider must be provided with multiple projections on one side for engaging multiple channels on a corresponding side of the zipper.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

What is claimed is:

1. A reclosable package comprising a receptacle having a mouth, and a slider-zipper assembly comprising a zipper and a slider mounted to said zipper, said zipper being joined to or integrally formed with said receptacle at said mouth, wherein said zipper comprises first and second interlockable zipper parts, said first zipper part comprising a first longitudinal channel having first and second obstructions and a substantially constant profile between said first and second obstructions, and wherein said slider causes confronting portions of said first and second zipper parts to engage during slider travel in a first direction and to disengage during slider travel in a second direction opposite to said first direction, said slider comprising a first projection arranged to project into and travel along said first longitudinal channel during slider travel, said first obstruction obstructing further travel of said slider in said first direction when said first projection impinges thereon.

2. The package as recited in claim 1, wherein said first obstruction comprises a dam.

3. The package as recited in claim 1, wherein said first obstruction comprises a constriction.

4. The package as recited in claim 1, wherein said first zipper part further comprises a second longitudinal channel having third and fourth obstructions and a substantially constant profile between said third and fourth obstructions, said first and second longitudinal channels being mutually parallel, and said slider further comprises a second projection arranged to project into and travel along said second longitudinal channel during slider travel.

5. The package as recited in claim 1, wherein said second obstruction obstructs further travel of said slider in said second direction when said first projection impinges thereon.

6. The package as recited in claim 1, wherein said slider further comprises a second projection arranged to project into and travel along said first longitudinal channel during slider travel, said second obstruction obstructing further travel of said slider in said second direction when said second projection impinges thereon.

7. The package as recited in claim 6, wherein said first and second projections are disposed at different elevations.

8. The package as recited in claim 1, wherein said second zipper part comprises a second longitudinal channel having third and fourth obstructions and a substantially constant profile between said third and fourth obstructions, and wherein said slider comprises a second projection arranged to project into and travel along said second longitudinal channel during slider travel, said third obstruction obstructing further travel of said slider in said first direction when said second projection impinges thereon.

9. The package as recited in claim 8, wherein said slider is not latched under said first or second zipper parts, and respective portions of said first and second longitudinal channels each resist liftoff of said slider from said zipper.

10. The package as recited in claim 1, wherein said first projection has a maximum width at a distance from its base, and said longitudinal channel has an opening of width less than said maximum width and greater than the width of said projection at said base.

11. The package as recited in claim 1, wherein said first and second zipper parts turn relative to each other about a fulcrum point, said first longitudinal channel being generally disposed at the height of said fulcrum point.

12. The package as recited in claim 1, wherein said slider further comprises a latching portion that is latched under a bottom surface of said second zipper part, said bottom surface of said second zipper part and a portion of said first longitudinal channel each resisting liftoff of said slider from said zipper.

13. The package as recited in claim 1, wherein said receptacle comprises front and rear walls disposed on opposing sides of a vertical plane, and said first and second zipper parts are joined to or integrally formed with said first and second walls, and said first projection assists in displacing an adjacent portion of said first zipper part relative to said second zipper part in a downward direction parallel to said vertical plane as said slider moves in said second direction.

14. The package as recited in claim 1, wherein said receptacle comprises front and rear walls disposed on opposing sides of a vertical, plane, and said first and second zipper parts are joined to or integrally formed with said first and second walls, and said first projection displaces an adjacent portion of said first zipper part relative to said second zipper part in a lateral direction transverse to said vertical plane as said slider moves in said second direction.

15. A reclosable package comprising a receptacle having a mouth, and a slider-zipper assembly comprising a zipper and a slider mounted to said zipper, said zipper being joined to or integrally formed with said receptacle at said mouth, wherein said zipper comprises first and second interlockable zipper parts, said first zipper part comprising a first longitudinal channel having first and second closed ends and a substantially constant profile between said first and second closed ends, and wherein said slider causes confronting portions of said first and second zipper parts to engage during slider travel in a first direction and to disengage during slider travel in a second direction opposite to said first direction, said slider comprising a first projection arranged to project into and travel along said first longitudinal channel during slider travel, said first closed end being in the path of said first projection when said slider travels in said first direction.

16. The package as recited in claim 15, wherein said second closed end of said first longitudinal channel is in the path of said first projection when said slider travels in said second direction.

17. The package as recited in claim 15, wherein said slider further comprises a second projection arranged to project into and travel along said first longitudinal channel during slider travel, said second closed end of said first longitudinal channel being in the path of said second projection when said slider travels in said second direction.

18. The package as recited in claim 15, wherein said second zipper part comprises a second longitudinal channel having third and fourth closed ends and a substantially constant profile between said third and fourth closed ends, and wherein said slider comprises a second projection arranged to project into and travel along said second longitudinal channel during slider travel, said third closed end of said second longitudinal channel being in the path of said second projection when said slider travels in said first direction.

19. A reclosable package comprising a receptacle having a mouth, and a slider-zipper assembly comprising a zipper and a slider mounted to said zipper, said zipper being joined to or integrally formed with said receptacle at said mouth, wherein said zipper comprises first and second interlockable zipper parts, said first zipper part comprising a longitudinal channel having a substantially constant profile and first and second slider end stops disposed in said channel, each of said first and second slider end stops not extending outside said channel, wherein said slider causes confronting portions of said first and second zipper parts to engage during slider travel in a first direction and to disengage during slider travel in a second direction opposite to said first direction, said slider comprising means for projecting into said longitudinal channel during slider travel, said first slider end stop posing an obstacle to further travel of said slider in said first direction when said projecting means impinge on said first slider end stop, and said second slider end stop posing an obstacle to further travel of said slider in said second direction when said projecting means impinge on said second slider end stop.

* * * * *